US005456509A

United States Patent [19]

Martin et al.

[11] Patent Number: 5,456,509

[45] Date of Patent: Oct. 10, 1995

[54] BARBECUE COAL AND ASH REMOVING SCOOPS

[76] Inventors: Roe J. Martin; Shirley R. Martin, both of 440 Paladin Cir., Litchfield Park, Ariz. 85340

[21] Appl. No.: 305,843

[22] Filed: Sep. 14, 1994

[51] Int. Cl.[6] ..... F23J 1/04

[52] U.S. Cl. ..... 294/9; 294/53.5; 294/55

[58] Field of Search ..... 294/7, 9, 10, 49, 294/51, 53.5, 55; 7/109, 116; 15/257.1, 257.4, 257.7; 126/242–244; 209/418, 419

[56] References Cited

U.S. PATENT DOCUMENTS

| | | | |
|---|---|---|---|
| 637,162 | 11/1899 | Rose | 15/257.7 |
| 958,255 | 5/1910 | Koertner | 15/257.7 |
| 1,160,748 | 11/1915 | Natale | 294/55 |
| 1,570,189 | 1/1926 | Sturm | 294/51 |
| 1,712,135 | 5/1929 | Cipko | 294/51 X |
| 2,505,113 | 4/1950 | Handley | 294/9 |
| 4,424,997 | 1/1984 | Jackson | 294/53.5 |

*Primary Examiner*—Johnny D. Cherry

[57] ABSTRACT

A barbecue coal and ash removing scoop, comprising a scoop formed in a planar configuration with a front edge, a rear edge and two side edges. Each side edge has a side wall extending upwardly therefrom. The rear edge includes generally rectangular shaped hinges affixed thereto. Each hinge includes a generally circular shaped aperture. A spreader shaft is formed in a generally cylindrical configuration with two slanted end regions and a linear central region therebetween. At least one of the end regions includes a slot. The linear central region of the spreader shaft is positioned through the apertures in the hinges of the scoop. The spreader shaft and handle are adapted to permit one hundred and eighty degree rotation of the scoop. A handle is formed in a long generally cylindrical configuration with a first end affixed to the center point of the spreader shaft. The handle has a second end which includes a generally cylindrical shaped hand grip affixed therearound.

5 Claims, 4 Drawing Sheets

PRIOR ART 10
50
16
38
21
34
14
46
24
22
36
26
24
22
20
26

BARBECUE COAL AND ASH REMOVING SCOOPS

BACKGROUND OF THE INVENTION

1. Field of the Invention

The present invention relates to barbecue coal and ash removing scoops and more particularly pertains to rearranging burning coals while cooking and removing coal ashes afterwards.

2. Description of the Prior Art

The use of ash removing devices is known in the prior art. More specifically, ash removing devices heretofore devised and utilized for the purpose of removing ashes from various structures are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,097,945 to Scott a folding garden tool.

U.S. Pat. No. 4,299,419 to Kalan discloses a fireplace ash cleaning shovel.

U.S. Pat. No. 4,491,357 to Richards discloses an ash separating shovel.

U.S. Pat. No. 4,619,474 to Dauphinais discloses an ash-removal shovel.

Lastly, U.S. Pat. No. 5,105,493 to Lugtenaar discloses a firefighting tool set.

In this respect, the barbecue coal and ash removing scoops according to the present invention substantially depart from the conventional concepts and designs of the prior art, and in so doing provide an apparatus primarily developed for the purpose of rearranging burning coals while cooking and removing coal ashes afterwards.

Therefore, it can be appreciated that there exists a continuing need for new and improved barbecue coal and ash removing scoops which can be used for rearranging burning coals while cooking and removing coal ashes afterwards. In this regard, the present invention substantially fulfills this need.

SUMMARY OF THE INVENTION

In view of the foregoing disadvantages inherent in the known types of ash removing devices now present in the prior art, the present invention provides an improved barbecue coal and ash removing scoop. As such, the general purpose of the present invention, which will be described subsequently in greater detail, is to provide a new and improved barbecue coal and ash removing scoop apparatus and method which has all the advantages of the prior art and none of the disadvantages.

To attain this, the present invention essentially comprises a new and improved barbecue coal and ash removing scoop comprising, in combination: a scoop fabricated of steel and formed in a planar generally rectangular configuration with a front edge, a rear edge and two parallel side edges, each side edge having a generally rectangular shaped side wall extending upwardly therefrom in a vertical orientation, the front corners of the scoop being rounded, the front edge extending a short distance beyond the forward most edge of the side walls, the rear edge including a centrally positioned generally rectangular shaped projection formed parallel with the plane of the scoop, the rear edge also including two generally rectangular shaped hinges affixed thereto in a vertical orientation, each hinge being affixed to the rear edge between the projection and each side edge of the scoop, each hinge including a generally circular shaped aperture extending therethrough; a spreader shaft fabricated of steel and formed in a general cylindrical configuration with two angled end regions-and a linear central region therebetween, each end region being slanted from the central region at an angle of between about one hundred and thirty five and one hundred and fifty degrees, a first angled end region including a centrally located horizontal slot shaped in a generally semicircular configuration, the slot including a downwardly extending notch formed in a generally semicircular configuration, the slot adapted to permit the user to lift a grill thereby allowing access to the coals of a barbecue grill, the linear central region of the spreader shaft being positioned through the apertures in the hinges of the scoop, the spreader shaft and handle adapted to permit one hundred and eighty degree rotation of the scoop therearound; and a handle fabricated of steel and formed in a long generally cylindrical configuration with an inboard end and an outboard end, the inboard end being affixed to the center point of the spreader shaft, the outboard end including a generally cylindrical shaped wooden hand grip, the wooden hand grip having a rounded outboard end and a rounded inboard end, the inboard end of the hand grip including a generally cylindrical shaped bore extending therein, the grip adapted to provide a firm griping surface for the user in the operative orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved barbecue coal and ash removing scoop which has all the advantages of the prior art ash removing devices and none of the disadvantages.

It is another object of the present invention to provide a new and improved barbecue coal and ash removing scoop which may be easily and efficiently manufactured and marketed.

It is a further object of the present invention to provide a new and improved barbecue coal and ash removing scoop which is of a durable and reliable construction.

An even further object of the present invention is to provide a new and improved barbecue coal and ash removing scoop which is susceptible of a low cost of manufacture with regard to both materials and labor, and which accordingly is then susceptible of low prices of sale to the consuming public, thereby making such ash removing devices economically available to the buying public.

Still yet another object of the present invention is to provide a new and improved barbecue coal and ash removing scoop which provides in the apparatuses and methods of the prior art some of the advantages thereof, while simultaneously overcoming some of the disadvantages normally associated therewith.

Still another object of the present invention is to rearrange burning coals while cooking and removing coal ashes afterwards.

Lastly, it is an object of the present invention to provide a new and improved barbecue coal and ash removing scoop, comprising a scoop formed in a planar configuration with a front edge, a rear edge and two side edges. Each side edge has a side wall extending upwardly therefrom. The rear edge includes generally rectangular shaped hinges affixed thereto. Each hinge includes a generally circular shaped aperture. A spreader shaft is formed in a generally cylindrical configuration with two slanted end regions and a linear central region therebetween. At least one of the end regions includes a slot. The linear central region of the spreader shaft is positioned through the apertures in the hinges of the scoop. The spreader shaft and handle are adapted to permit one hundred and eighty degree rotation of the scoop. A handle is formed in a long generally cylindrical configuration with a first end affixed to the center point of the spreader shaft. The handle has a second end which includes a generally cylindrical shaped hand grip affixed therearound.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
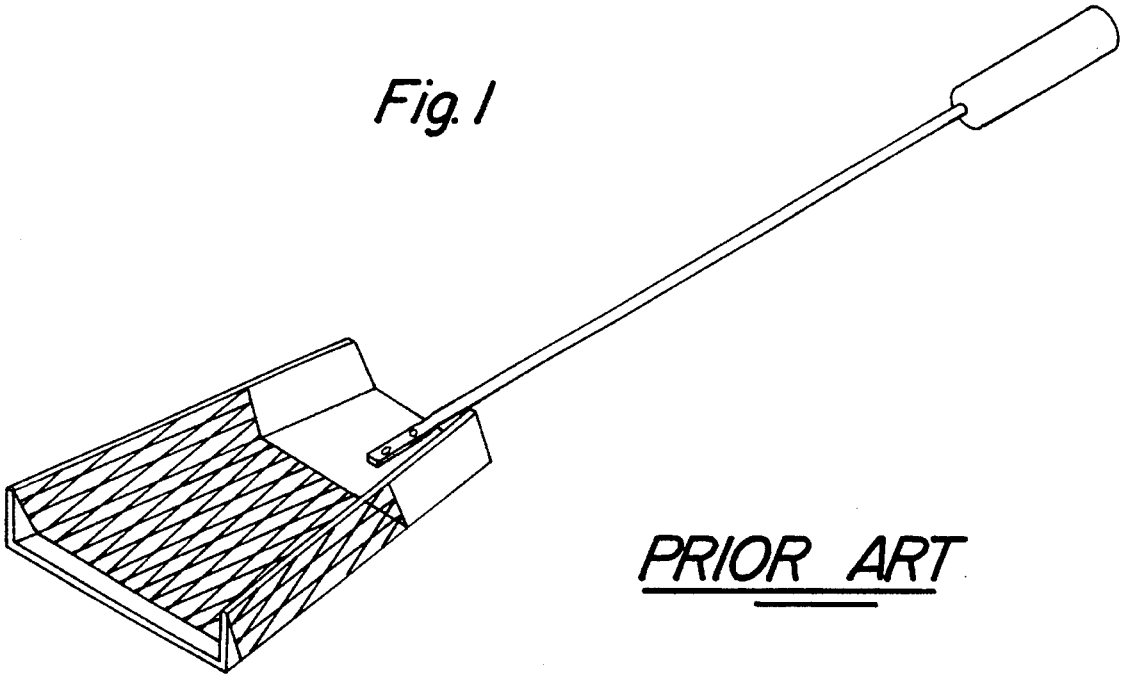
FIGS. 1 and 2 are perspective illustrations of prior art ash removing devices.
Figure 2:
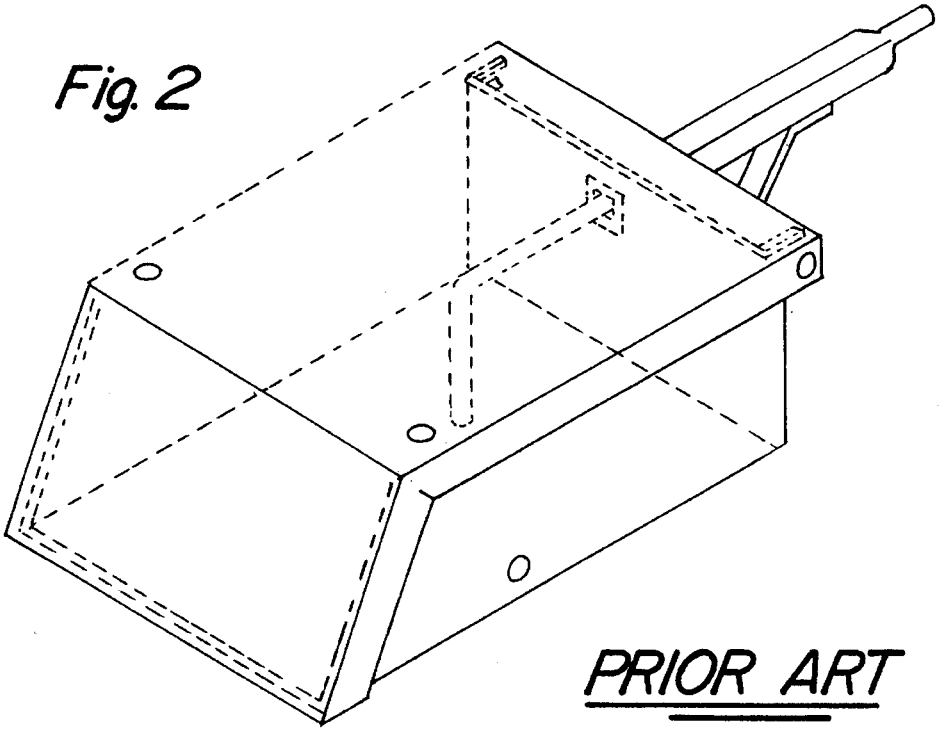
PRIOR ART Fig. 2
Figure 3:
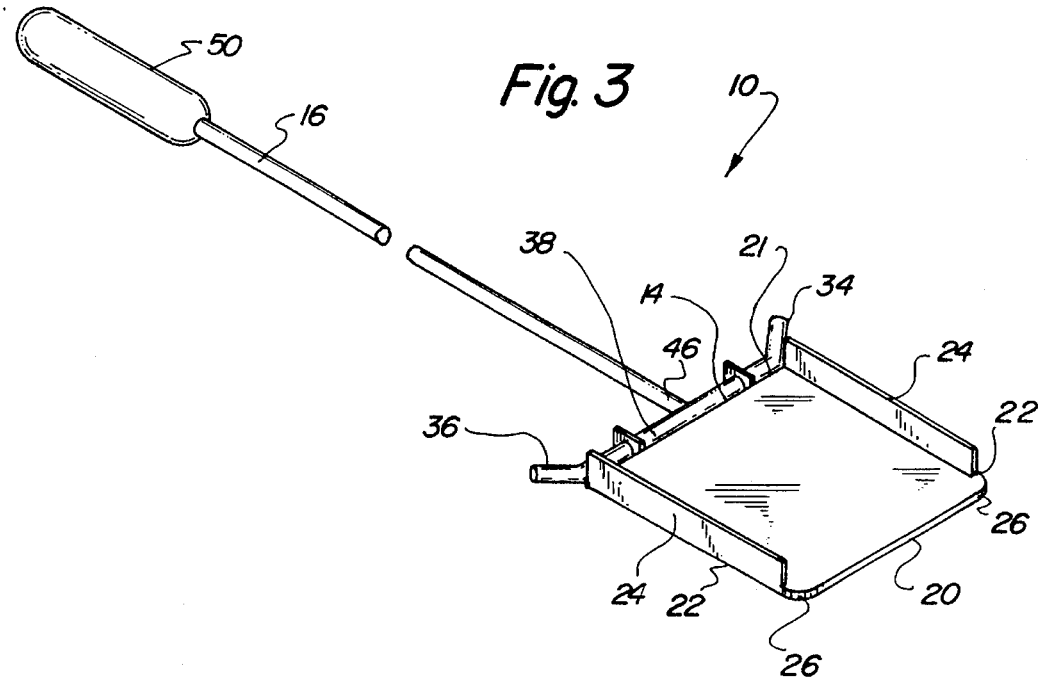
FIG. 3 is a perspective illustration of the preferred embodiment of the barbecue coal and ash removing scoops constructed in accordance with the principles of the present invention.

With reference now to the drawings, and in particular to FIG. 3 thereof, a new and improved barbecue coal and ash removing scoop embodying the principles and concepts of the present invention and generally designated by the reference numeral 10 will be described.

The present invention, the new and improved barbecue coal and ash removing scoop, is comprised of a plurality of components. Such components in their broadest context include a scoop 12, a spreader shaft 14 and a handle 16. Such components are individually configured and correlated with respect to each other so as to attain the desired objective.

Figure 5:
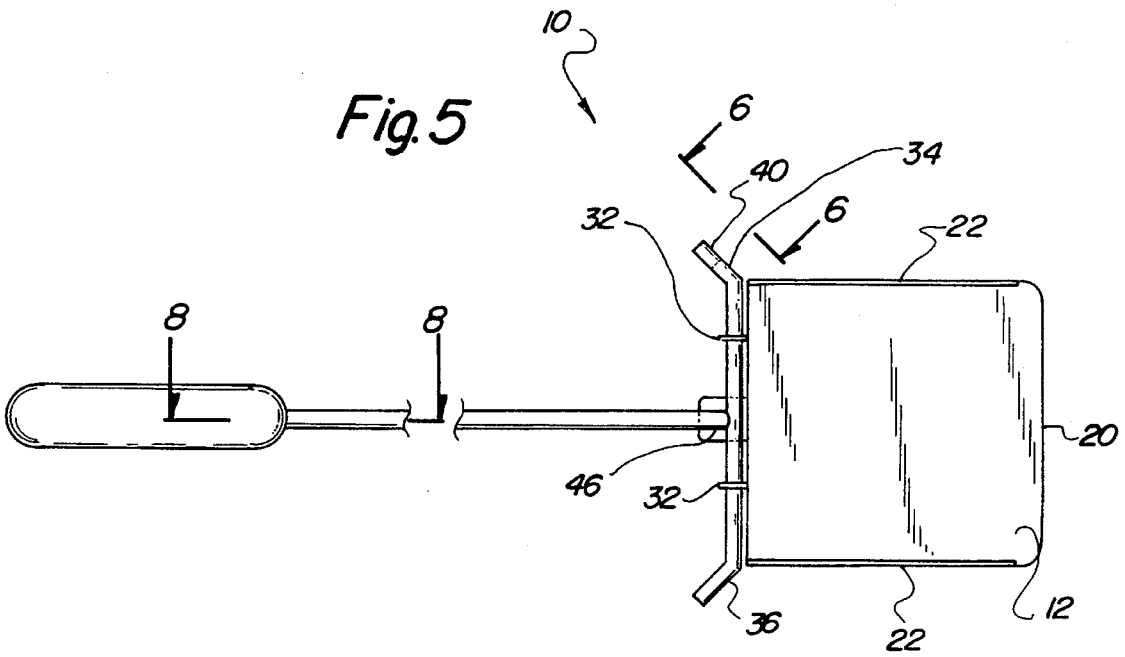
FIG. 5 is a top plan view of the barbecue coal and ash removing scoop.

A scoop 12 is fabricated of steel and formed in a planar generally rectangular configuration with a front edge 20, a rear edge 21 and two parallel side edges 22. Each side edge has a generally rectangular shaped side wall 24 extending upwardly in a vertical orientation. The side walls prevent removed ashes from falling off the scoop while being disposed. The front corners 26 of the scoop are rounded. The front edge 20 extends a short distance beyond the forward most edge of the side wall. This configuration adds to the utility of the apparatus by providing a scraping surface to help remove ash material. Note FIGS. 3 and 5.

Figure 4:
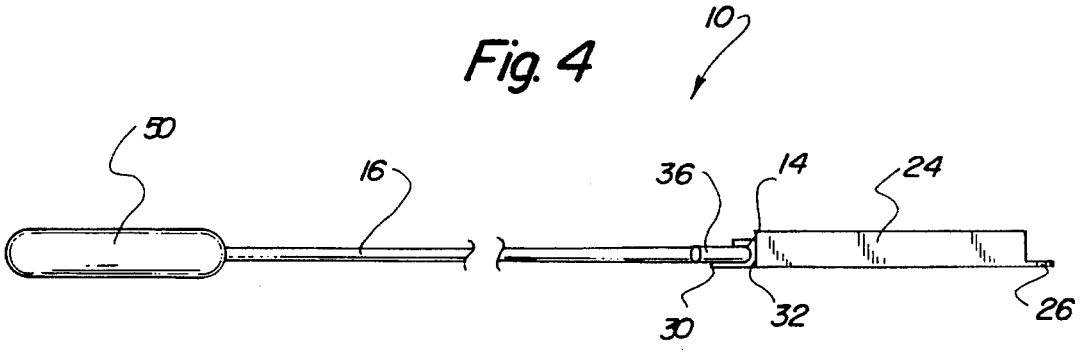
FIG. 4 is a side perspective view of the barbecue coal and ash removing scoop shown in FIG. 3.
Figure 7:
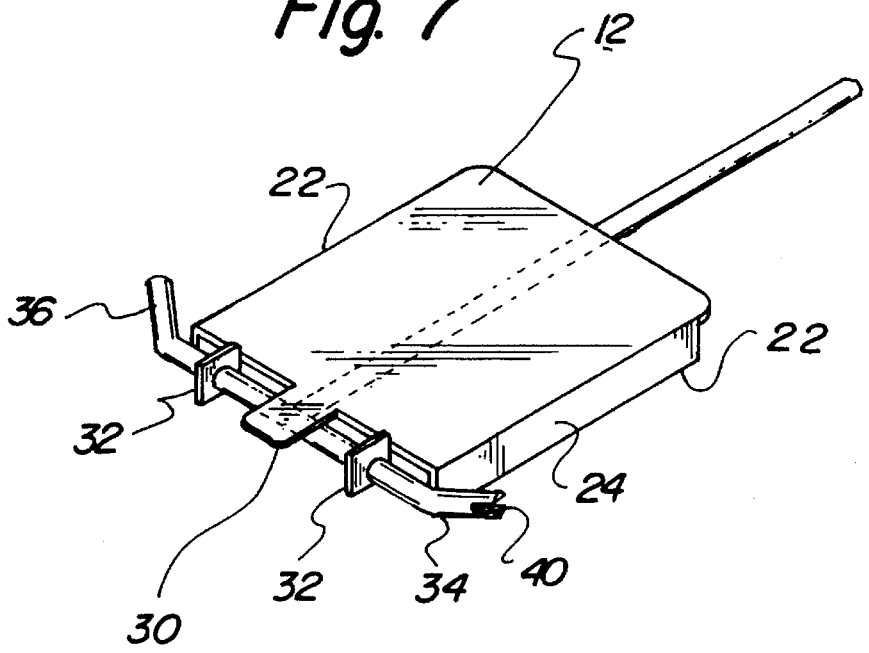
FIG. 7 is a perspective view of the apparatus illustrating the shovel in the folded closed position.

The rear edge includes a centrally positioned, generally rectangular shaped projection 30 formed parallel with the plane of the scoop. The projection retains the scoop in a one hundred and eighty degree orientation with respect to the handle of the apparatus. The rear edge also includes two generally rectangular shaped hinges 32 affixed thereto in a vertical orientation. Each hinge is affixed to the rear edge between the projection and each side edge of the scoop. Each hinge includes a generally circular shaped aperture extending therethrough. The hinge is adapted to permit the user to fold the scoop rearwardly so that it lays on the handle when the scoop is not being utilized. Note FIGS. 3, 4 and 7.

Figure 6:
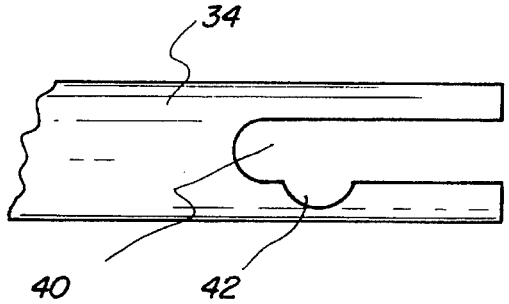
FIG. 6 is a perspective view of the first angled region of the shaft taken along section line 6—6 of FIG. 5.

A spreader shaft 14 is fabricated of steel and formed in a generally cylindrical configuration with two angled end regions 34, 36 and a linear central region 38 therebetween. Each end region is slanted from the central region at an angle of between about one hundred and twenty five and one hundred and fifty degrees. A first angled end region 34 includes a centrally located horizontal slot 40 shaped in a generally semicircular configuration. The slot includes a downwardly extending notch 42 formed in a generally semicircular configuration. Note FIG. 6.

The slot is adapted to permit the user to lift a grill grid by placing the slot therearound. This allows the user access to the coals of a barbecue grill for the purpose of scooping the ashes. The second end of the spreader shaft may be utilized to move around hot coals while cooking is being performed. The linear region of the spreader shaft is positioned through the apertures in the hinges of the scoop. The spreader shaft and handle are adapted to permit one hundred and eighty degree rotation of the scoop therearound. Note FIGS. 4, 6 and 7.

Figure 8:
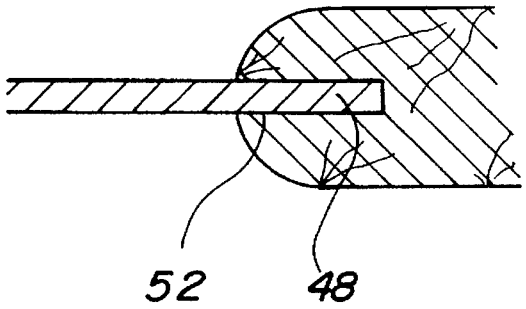
FIG. 8 is a cross sectional view of the apparatus taken along line 8—8 of FIG. 5.

A handle 16 is fabricated of steel and formed in a long generally cylindrical configuration with an inboard end 46 and an outboard end 48. The inboard end is affixed to the center point of the spreader shaft. The sturdy construction of the handle permits the user to remove large quantities of coal ashes. The outboard end of the handle includes a generally cylindrical shaped wooden hand grip 50. Note FIG. 8. The wooden hand grip has a rounded outboard end and a rounded inboard end. The inboard end of the hand grip includes a generally cylindrical shaped bore 52 extending therein. The hand grip is adapted to provide a firm gripping surface for the user in the operative orientation. The wooden construction of the hand grip prevents excessive heating thereof when utilizing the apparatus. Note FIGS. 5 and 8.

The present invention is a specially designed scoop for use in barbecuing. In addition to removing ashes after cooking, the present invention makes it easy to arrange burning coals and even remove a hot grill without protective gloves.

The present invention consists of a scoop that resembles a large spatula in many respects. The present invention includes a one quarter inch diameter steel handle that measures twenty eight inches in length. The handle has a round wooden hand grip on its end. The scoop consists of a piece of flat steel measuring about six inches square. It is hinged along its rear edge. This allows the scoop to rotate back so that it rests against the handle. The spreader shaft is positioned parallel to the rear of the scoop. A handle is positioned perpendicular to the shaft. The hinges are attached to the rear of the scoop with the spreader rod positioned therethrough. Both ends of the spreader shaft stick out on an angle. One end includes a small notch or hook.

Users may utilize the scoop to remove ashes after cooking has been completed and the hot coals have cooled. The user rotates the scoop back to use the spreader shaft to adjust the position of the coals. The hook on one end of the shaft is convenient for grabbing a hot grill and lifting it up to gain access to the coals. The present invention reduces the need for multiple implements to perform these functions. It saves time and money and offers greater convenience.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A barbecue coal and ash removing scoop comprising, in combination:

a scoop fabricated of steel and formed in a planar generally rectangular configuration with a front edge, a rear edge and two parallel side edges, each side edge having a generally rectangular shaped side wall extending upwardly therefrom in a vertical orientation, the front corners of the scoop being rounded, the front edge extending a short distance beyond the forward most edge of the side walls, the rear edge including a centrally positioned generally rectangular shaped projection formed parallel with the plane of the scoop, the rear edge also including two generally rectangular shaped hinges affixed thereto in a vertical orientation, each hinge being affixed to the rear edge between the projection and each side edge of the scoop, each hinge including a generally circular shaped aperture extending therethrough;

a spreader shaft fabricated of steel and formed in a general cylindrical configuration with two angled end regions and a linear central region therebetween, each end region being slanted from the central region at an angle of between about one hundred and thirty five and one hundred and fifty degrees, a first angled end region including a centrally located horizontal slot shaped in a generally semicircular configuration, the slot including a downwardly extending notch formed in a generally semicircular configuration, the slot adapted to permit the user to lift a grill thereby allowing access to the coals of a barbecue grill, the linear central region of the spreader shaft being positioned through the apertures in the hinges of the scoop, the spreader shaft adapted to permit one hundred and eighty degree rotation of the scoop therearound; and a handle fabricated of steel and formed in a long generally cylindrical configuration with an inboard end and an outboard end, the inboard end being affixed to the center point of the spreader shaft, the outboard end including a generally cylindrical shaped wooden hand grip, the wooden hand grip having a rounded outboard end and a rounded inboard end, the inboard end of the hand grip including a generally cylindrical shaped bore extending therein, the grip adapted to provide a firm gripping surface for the user in the operative orientation.

2. A barbecue coal and ash removing scoop, comprising:

a scoop formed in a planar configuration with a front edge, a rear edge and two side edges, each side edge having a side wall extending upwardly therefrom, the rear edge including generally rectangular shaped hinges affixed thereto, each hinge including a generally circular shaped aperture, a spreader shaft formed in a generally cylindrical configuration with two slanted end regions and a linear central region therebetween, at least one of the end regions including a slot, the linear central region of the spreader shaft being positioned through the apertures in the hinges of the scoop, the spreader shaft adapted to permit one hundred and eighty degree rotation of the scoop, a handle formed in a long generally cylindrical configuration with a first end affixed to the center point of the spreader shaft, the handle having a second end including a generally cylindrical shaped hand grip affixed therearound.

3. The barbecue coal and ash removing Scoop as set forth in claim 2 wherein the scoop is formed in a generally planar rectangular configuration.

4. The barbecue coal and ash removing scoop as set forth in claim 2 wherein the slanted end regions of the spreader shaft are angled at between about ninety and one hundred and eighty degrees with respect to the central region.

5. The barbecue coal and ash removing scoop as set forth in claim 2 wherein the handle includes a wooden hand grip.

* * * * *